US007407238B2

(12) United States Patent
Fitzgerald

(10) Patent No.: US 7,407,238 B2
(45) Date of Patent: Aug. 5, 2008

(54) DISPENSERS WITH REMOVABLE STORAGE CARTRIDGES

(75) Inventor: Robert M. Fitzgerald, Norcross, GA (US)

(73) Assignee: Innovative Product Achievements, Duluth, GA (US)

( * ) Notice: Subject to any disclaimer, the term of this patent is extended or adjusted under 35 U.S.C. 154(b) by 325 days.

(21) Appl. No.: 11/122,285

(22) Filed: May 3, 2005

(65) Prior Publication Data

US 2006/0250056 A1 Nov. 9, 2006

(51) Int. Cl.
*A47B 96/00* (2006.01)

(52) U.S. Cl. ..... 312/311; 312/249.9

(58) Field of Classification Search ..... 312/249.1, 312/249.9, 326, 329, 307, 318, 292, 310, 312/311, 319.1
See application file for complete search history.

(56) References Cited

U.S. PATENT DOCUMENTS

| | | | | | |
|---|---|---|---|---|---|
| 2,130,617 | A | * | 9/1938 | Dockham | 312/291 |
| 2,518,985 | A | * | 8/1950 | Geyh | 312/273 |
| 2,665,184 | A | | 1/1954 | Hord | |
| 2,723,176 | A | * | 11/1955 | Richter et al. | 312/318 |
| 2,799,430 | A | | 7/1957 | Kintzel | |
| 3,058,320 | A | * | 10/1962 | Foster et al. | 62/382 |
| 3,261,650 | A | | 7/1966 | Stromqvist | |
| 3,392,543 | A | | 7/1968 | Miller | |
| 3,486,658 | A | | 12/1969 | Cheslak et al. | |
| 3,690,118 | A | | 9/1972 | Rainwater | |
| 3,719,408 | A | | 3/1973 | Fullington et al. | |
| 3,752,550 | A | | 8/1973 | Niemcyer | |
| 3,834,865 | A | | 9/1974 | Lee | |
| 3,861,768 | A | | 1/1975 | Wilson | |
| 3,861,769 | A | * | 1/1975 | Jenkins | 312/311 |
| 3,905,662 | A | | 9/1975 | Richmond | |
| 4,008,827 | A | | 2/1977 | Appelbaum et al. | |
| 4,034,572 | A | | 7/1977 | Morris et al. | |
| 4,077,228 | A | | 3/1978 | Schumacher et al. | |
| 4,087,020 | A | | 5/1978 | Krakauer | |
| 4,365,854 | A | | 12/1982 | Waller | |
| 4,418,969 | A | | 12/1983 | Hettman | |
| 4,869,395 | A | | 9/1989 | Rubbmark | |
| 4,915,462 | A | | 4/1990 | Le Marchand et al. | |
| 4,959,582 | A | * | 9/1990 | Meyer et al. | 312/307 |
| 5,745,366 | A | * | 4/1998 | Higham et al. | 700/242 |
| 5,860,714 | A | | 1/1999 | Skord, Jr. | |
| 6,385,505 | B1 | | 5/2002 | Lipps | |

(Continued)

FOREIGN PATENT DOCUMENTS

GB 943675 * 12/1963

*Primary Examiner*—James O Hansen
(74) *Attorney, Agent, or Firm*—Alston & Bird LLP

(57) ABSTRACT

A dispenser comprising: (1) a dispenser housing that includes: (a) a dispenser body that defines both an interior portion and an access opening, and (b) an access door that is mounted to selectively restrict access to the interior portion through the access opening; (2) a storage cartridge that is mounted on wheels to roll adjacent the dispenser body; and (3) a storage cartridge positioning system that is adapted to facilitate moving the storage cartridge into a "loading position" in which the storage cartridge is positioned to be loaded into the dispenser. The motion of the access door from an open position to a closed position may serve to urge the storage cartridge from the "loading position" into a "loaded position" in which the storage cartridge is disposed substantially within the dispenser housing.

22 Claims, 7 Drawing Sheets

U.S. PATENT DOCUMENTS

| | | | |
|---|---|---|---|
| 6,572,207 | B2 | 6/2003 | Hase et al. |
| 6,595,606 | B1 | 7/2003 | Gunst |
| 6,616,010 | B2 | 9/2003 | Yuyama et al. |
| 6,626,508 | B1 | 9/2003 | Hase et al. |
| 6,824,231 | B2 | 11/2004 | Jakob-Bamberg et al. |
| 2004/0124751 | A1 | 7/2004 | Arent et al. |

* cited by examiner

DISPENSERS WITH REMOVABLE STORAGE CARTRIDGES

BACKGROUND OF THE INVENTION

Automated dispensers are currently used to dispense items ranging from food items, to beverages, to linen items. However, there is a need for improved dispensers that, for example, are easier to load than current dispensers.

SUMMARY OF THE INVENTION

A dispenser according to one embodiment of the invention comprises: (1) a dispenser housing that includes a dispenser body that defines both an interior portion and a dispenser body access opening, and an access door that is mounted to selectively restrict access to the dispenser body's interior portion through the dispenser body's access opening; (2) a storage cartridge that is mounted on one or more rolling mechanisms to roll adjacent the dispenser body; and (3) a storage cartridge positioning system that is adapted to facilitate moving the storage cartridge into a "loading position" in which the storage cartridge is positioned to be loaded into the dispenser housing. The dispenser is preferably configured so that when the storage cartridge is in the loading position, the access door may be moved between: (1) a first, "open" position, in which the access door does not substantially restrict access to the interior portion through the access opening, and (2) a second, "closed" position, in which the access door restricts access to the interior portion through the access opening. The dispenser is preferably further configured so that the motion of the access door from the open position to the closed position serves to urge the storage cartridge from the "loading position" into a "loaded position" in which the storage cartridge is disposed substantially within the dispenser housing.

In various embodiments of the invention, the storage cartridge positioning system is adapted to receive a rolling mechanism and to maintain the rolling mechanism in a substantially fixed lateral position relative to the dispenser housing as the storage cartridge is being moved from the "loading position" into the "loaded position". In addition, in certain embodiments of the invention, the storage cartridge positioning system comprises a rolling mechanism guide that is adapted to guide the particular rolling mechanism into a predetermined position relative to the dispenser housing.

In particular embodiments of the invention, the storage cartridge positioning system includes a position sensing system that comprises: (A) a sensor that is adapted for determining whether the cartridge is in a proper "loading position"; and (B) an alert mechanism that is adapted for issuing an alert to a user in response to the sensor determining that the cartridge is not in a proper "loading position". The dispenser may further comprise a storage cartridge restraint that is adapted for substantially restricting the lateral movement of the storage cartridge relative to the access door, and that is mounted adjacent the access door. In certain embodiments of the invention, the dispenser may also include a stopping mechanism for restricting further movement of the storage cartridge toward the dispenser housing after the storage cartridge has moved into the "loaded position".

A cartridge storage system according to a further embodiment of the invention comprises: (1) a housing defining both an interior portion and a housing access opening; (2) a storage cartridge that is mounted on one or more rolling mechanisms to roll adjacent the dispenser body, at least a particular one of the rolling mechanisms being mounted to swivel relative to the storage cartridge; and (3) a rolling mechanism retaining member that is adapted to receive the particular rolling mechanism. In this embodiment of the invention, the storage cartridge may be adapted to be rolled between: (a) a first position in which the storage cartridge is disposed substantially outside of the interior portion of the housing; and (b) a second position in which the storage cartridge is disposed substantially within the interior portion of the housing. In addition, the rolling mechanism retaining member may be adapted to maintain the particular rolling mechanism in a substantially fixed lateral relationship to the housing while the storage cartridge is being rolled between the first and second positions.

A method of inserting a cartridge into an dispenser according to various embodiments of the invention includes the steps of: (1) providing a dispenser comprising: (a) a dispenser housing that includes a dispenser body that defines both an interior portion and a dispenser body access opening, (b) a storage cartridge that is mounted on one or more rolling mechanisms to roll adjacent the dispenser body, and (c) a storage cartridge positioning member that is adapted to receive a particular one of the one or more rolling mechanisms; (2) positioning the storage cartridge so that the particular rolling mechanism is received by the storage cartridge positioning member; and (3) rolling the storage cartridge substantially into an interior portion of the dispenser body while the storage cartridge positioning member maintains the particular rolling mechanism in a substantially fixed lateral relationship relative to the dispenser housing.

In various embodiments of the invention, the step of rolling the storage cartridge comprises rolling the storage cartridge substantially into an interior portion of the dispenser body while the storage cartridge positioning member maintains the particular rolling mechanism in a substantially fixed position. Also, in certain embodiments of the invention, the step of rolling the storage cartridge comprises rolling the storage cartridge toward and into the interior portion of the dispenser body until a second of the "one or more rolling mechanisms" engages a stopper mechanism. In addition, in various embodiments of the invention, the dispenser housing comprises an access door that is mounted to provide selective access to the dispenser body's interior portion, and the step of rolling the storage cartridge comprises using the access door to urge the storage cartridge toward and into the interior portion of the dispenser body. In certain embodiments of the invention, the above method includes attaching the storage cartridge adjacent the access door before using the access door to urge the storage cartridge toward and into the interior portion of the dispenser body.

BRIEF DESCRIPTION OF THE DRAWINGS

Figure 1:
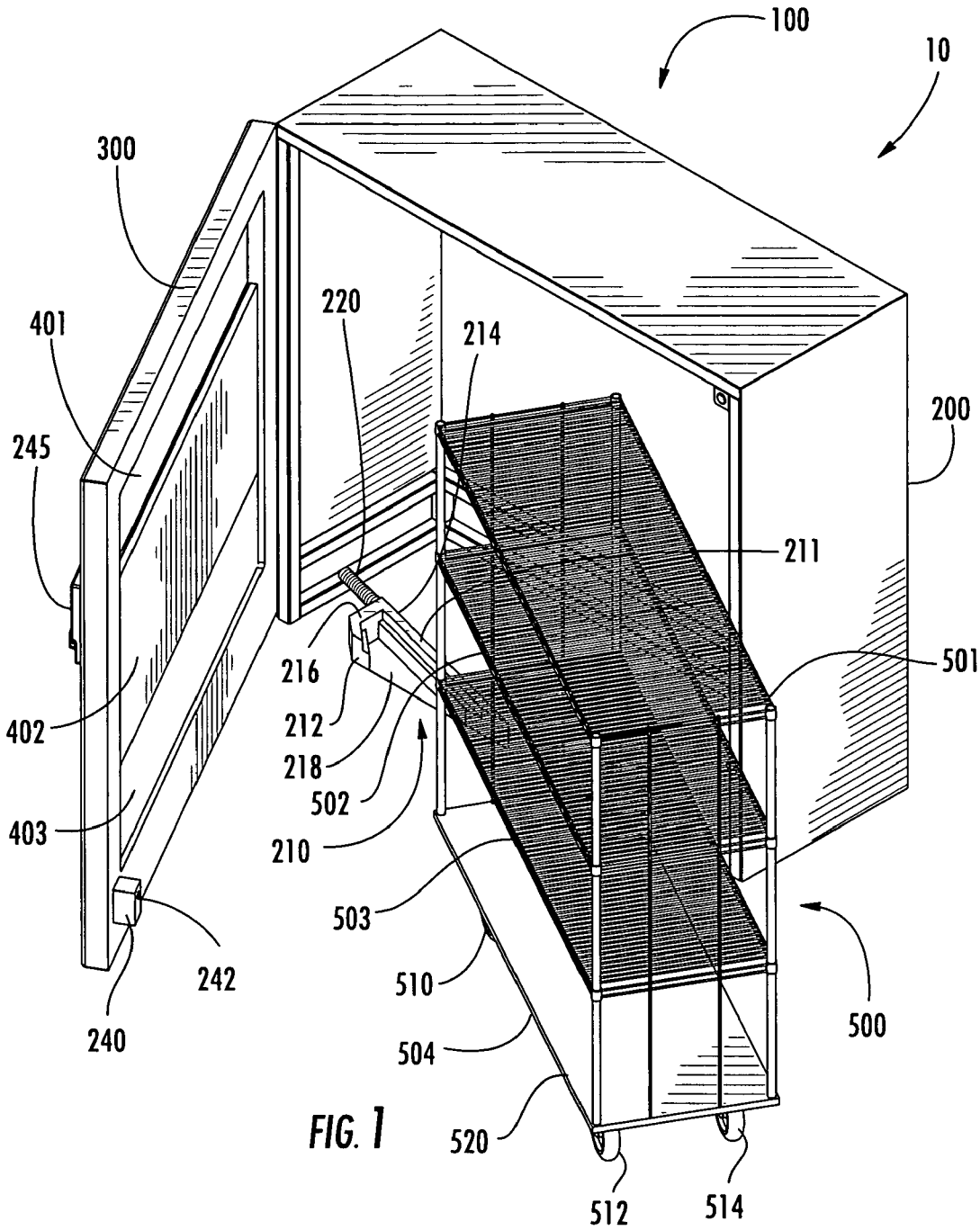

Having thus described the invention in general terms, reference will now be made to the accompanying drawings, which are not necessarily drawn to scale, and wherein:

FIG. 1 is a perspective front view of a dispenser according to one embodiment of the invention.

Figure 2:
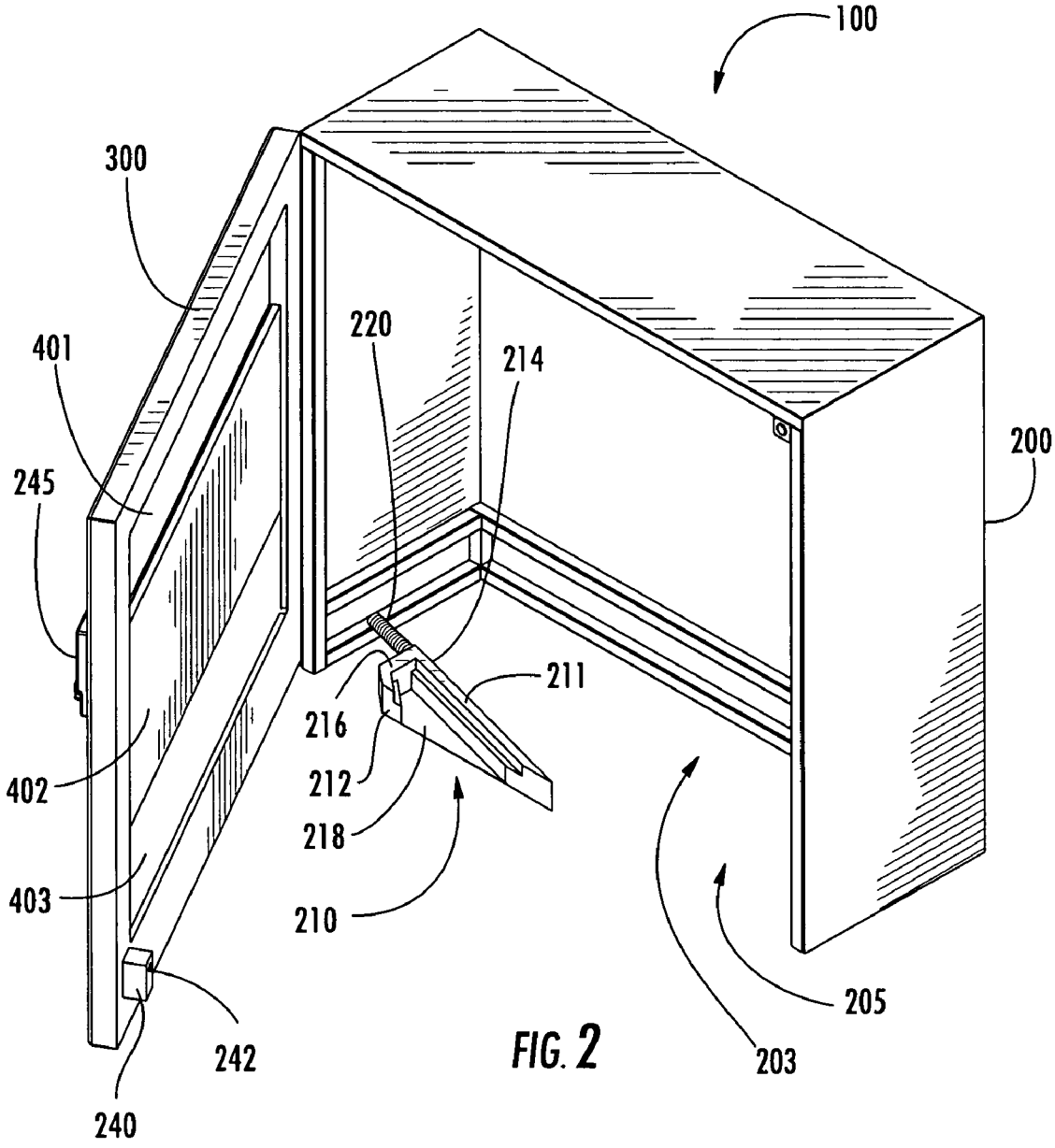

FIG. 2 is a perspective front view of the dispenser shown in FIG. 1, in which the dispenser's storage cartridge has been removed from view.

Figure 3:
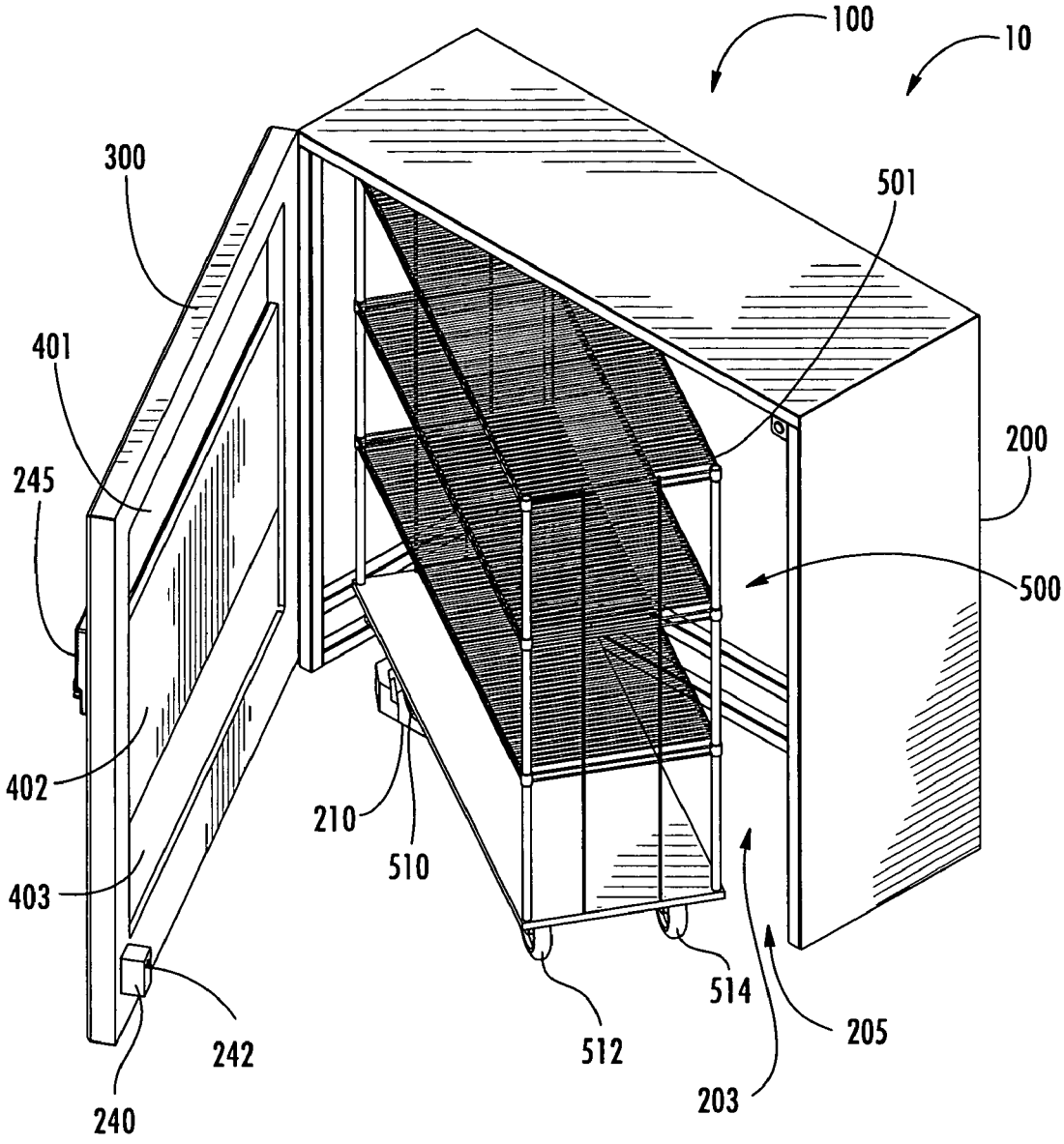
Figure 4:
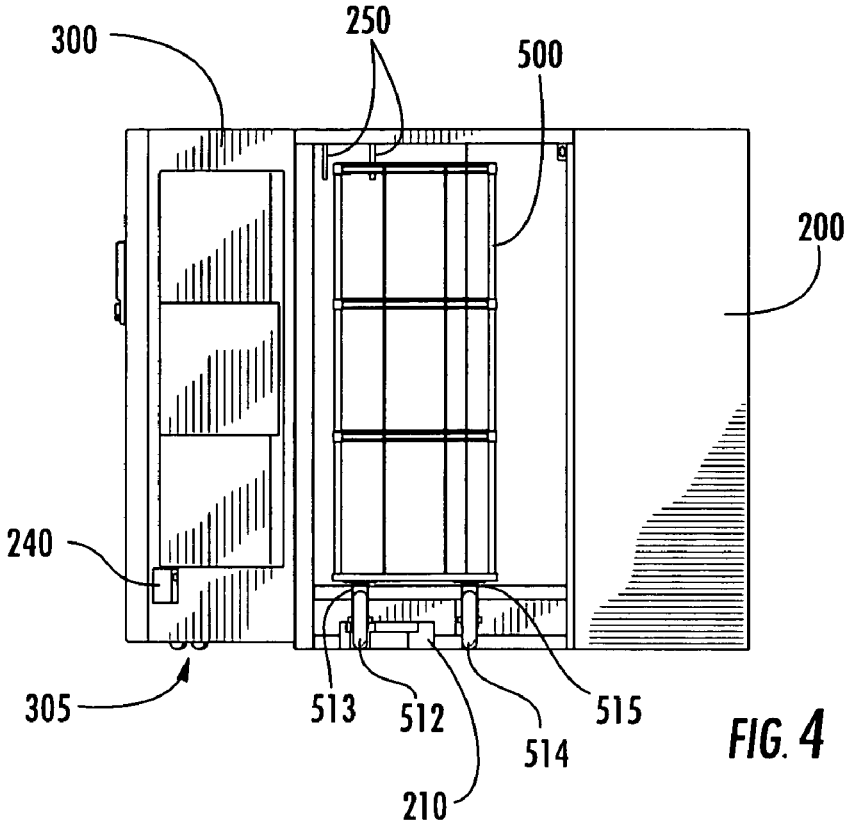
Figure 5:
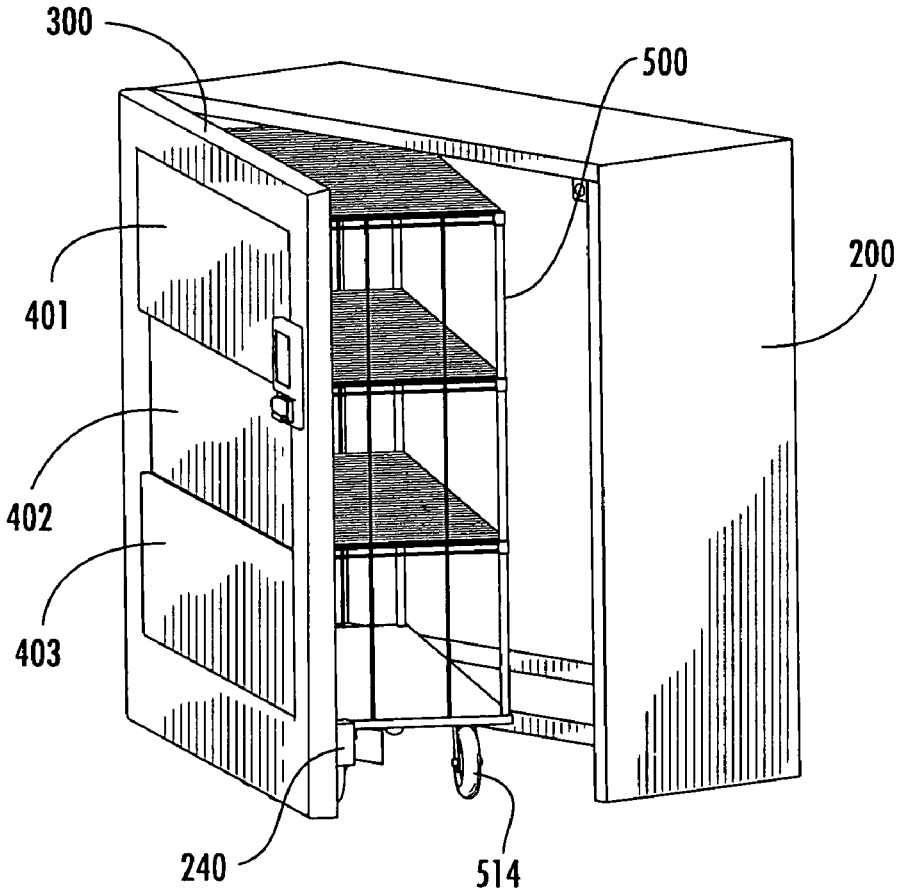
Figure 6:
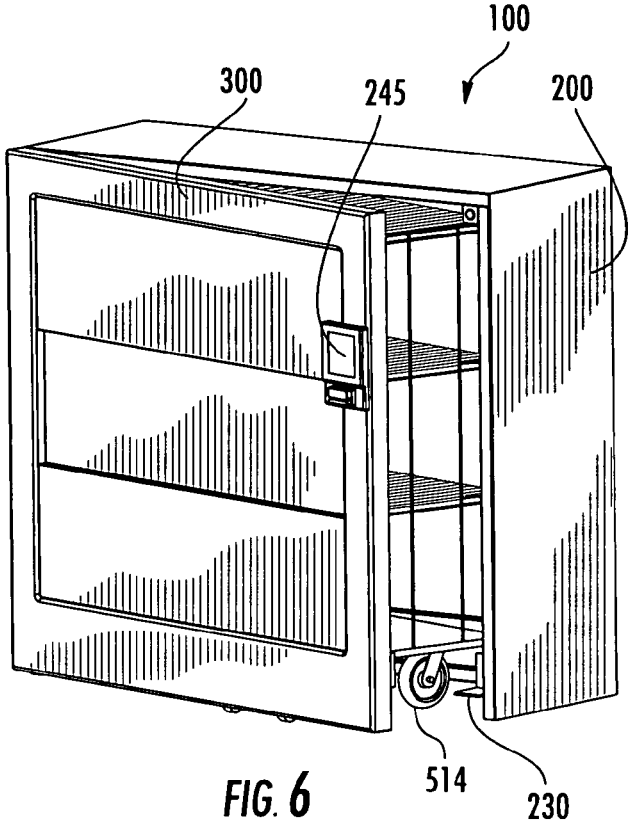

FIGS. 3-6 are a perspective front views of the dispenser shown in FIG. 1, in which a rolling mechanism associated with the storage cartridge is received by a rolling mechanism guide. FIG. 3 shows the storage cartridge in a "loading position".

Figure 7:
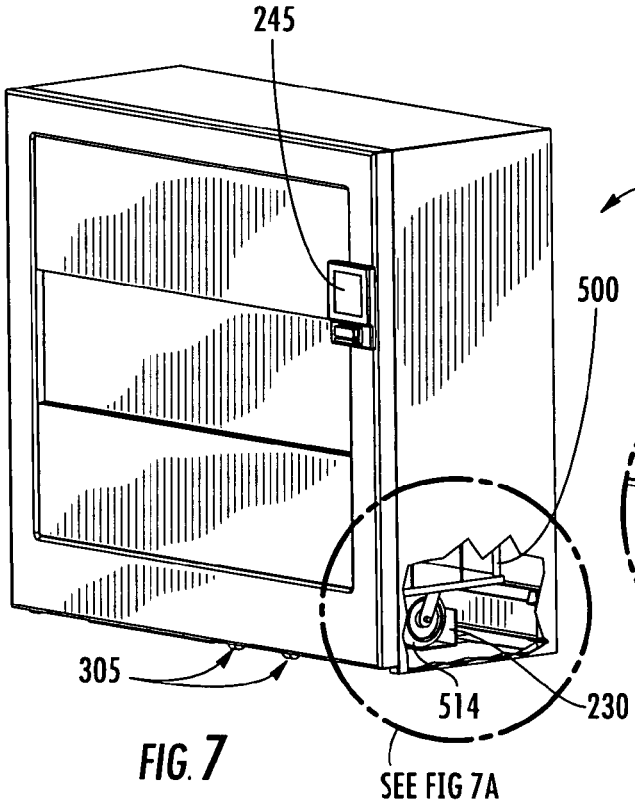
Figure 7A:
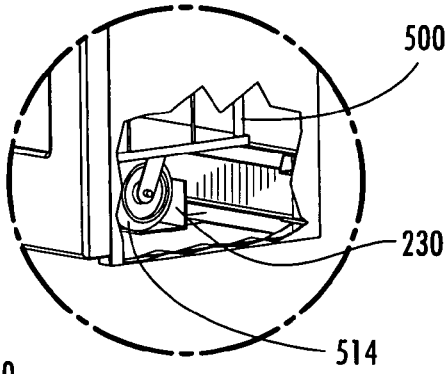

FIGS. 7 and 7A are perspective front cut-away views of the dispenser shown in FIG. 1, in which the dispenser's storage cartridge is disposed entirely within the dispenser, and the dispenser's access door is in a closed position. FIG. 7 shows the storage cartridge in a "loaded position".

Figure 8:
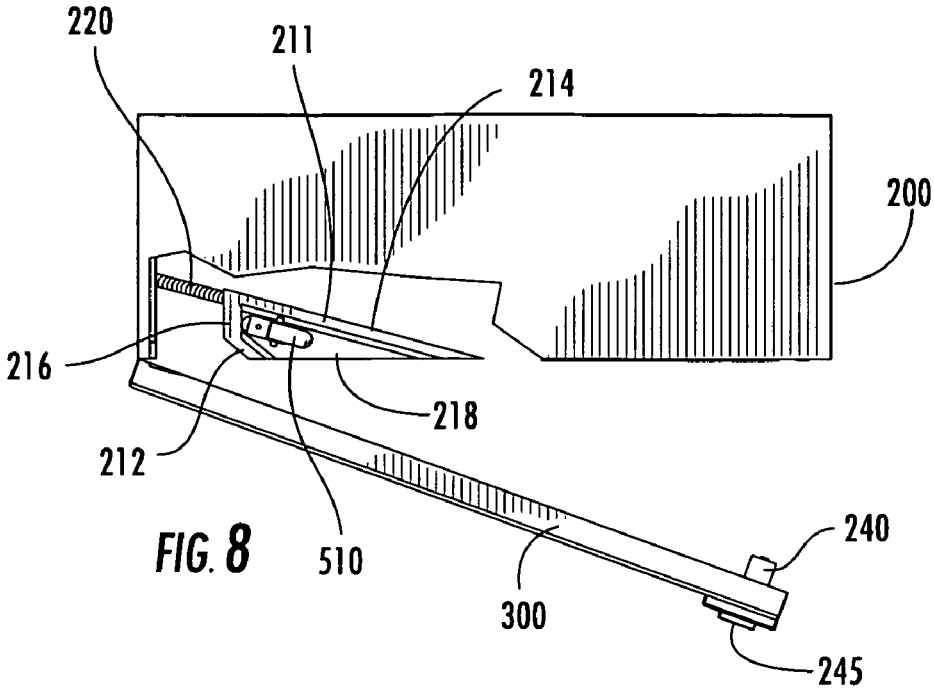

FIG. 8 is a perspective top cut-away view showing the position of a rolling mechanism associated with the storage cartridge when the rolling mechanism is: (1) received by the rolling mechanism guide; and (2) disposed immediately adjacent the rolling mechanism guide's stopper. The storage cartridge has been omitted from view in this figure in order to provide a clear top view of the rolling mechanism.

Figure 9:
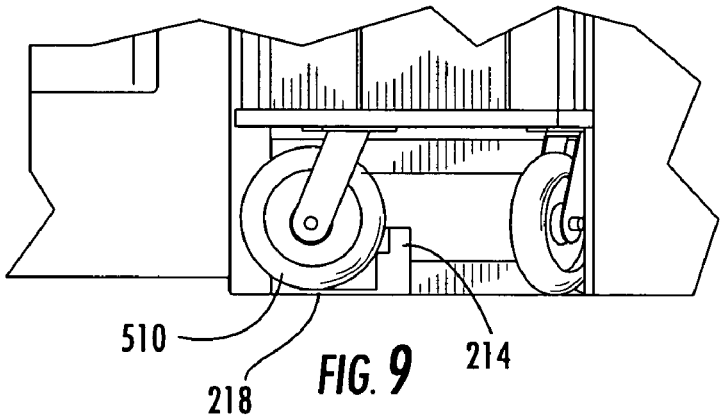

FIG. 9 is a perspective view showing a rolling mechanism associated with the storage cartridge initially engaging the rolling mechanism guide's rear guide rail.

Figure 10:
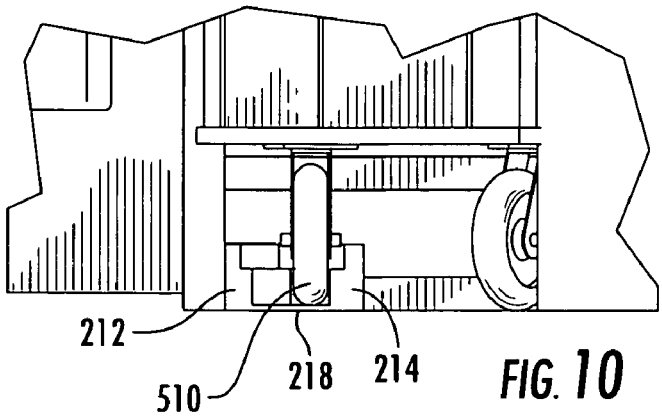

FIG. 10 is a perspective view showing a rolling mechanism associated with the storage cartridge as the rolling mechanism rolls toward the rolling mechanism guide's stopper.

Figure 11:
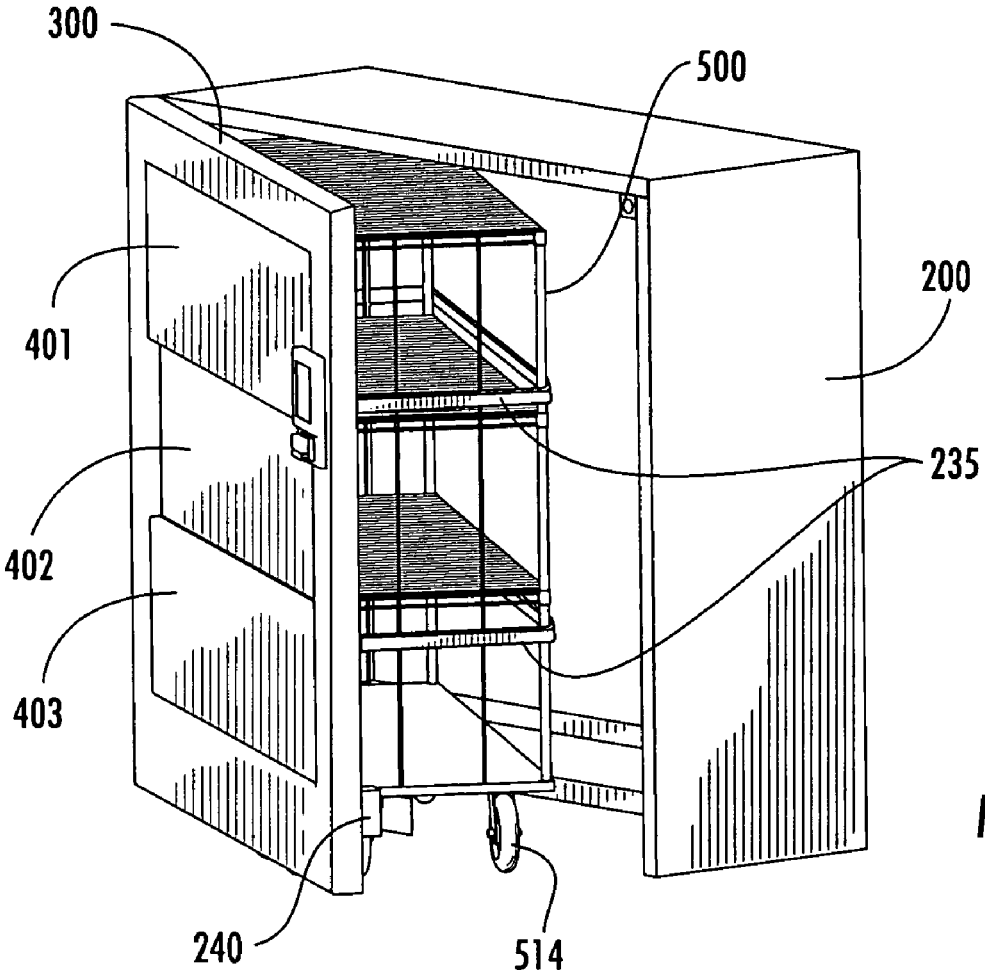

FIG. 11 is a front perspective view of a dispenser according to a further embodiment of the invention in which the storage cartridge is shown attached adjacent the dispenser's access door.

DETAILED DESCRIPTION OF VARIOUS EMBODIMENTS OF THE INVENTION

The present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Structure of Various Embodiments of the Invention

Overview of the Dispenser's General Structure

A dispenser 10 according to one embodiment of the invention is shown in FIG. 1. As may be understood from this figure, in this embodiment of the invention, the dispenser 10 comprises: (1) a storage cartridge 500; (2) one or more rolling mechanisms 510, 512, 514 associated with the storage cartridge 500; (3) a dispenser housing 100; (4) a storage cartridge positioning system that comprises a rolling mechanism guide 210 and storage cartridge positioning guides 250 (see FIG. 4); (5) a position sensing system that comprises a sensor 242 and an alert mechanism 245; and (6) a stopping mechanism 230 (See FIGS. 6 and 7). In another embodiment of the invention, the dispenser 10 further includes a storage cartridge restraint 240 and/or a storage cartridge attachment mechanism 235. The various components of the dispenser 10 are discussed in greater detail below.

Storage Cartridge

One embodiment of the storage cartridge 500 is shown in FIG. 1. As may be understood from this figure, in this embodiment of the invention, the storage cartridge 500 comprises a plurality of substantially horizontal, substantially rectangular, shelves 501-504 that are spaced apart from, and substantially parallel to, each other. These shelves 501-504 may be of any appropriate shape and/or structure (e.g., spaced apart slats or solid material), and may be made of any appropriate material (e.g., metal or wood). The storage cartridge's shelves 501-504 may be supported by any appropriate support system. For example, in the embodiment shown in FIG. 1, the storage cartridge's shelves 500 are supported by vertical support columns disposed adjacent the storage cartridge's respective corners.

Rolling Mechanisms

In various embodiments of the invention, the storage cartridge 500 is mounted on one or more rolling mechanisms (such as wheels or rollers). For example, in the embodiment of the invention shown in FIG. 1, the storage cartridge 500 is mounted on four wheels 510, 512, 514, (fourth wheel not shown), and each of these wheels 510, 512, 514 is mounted adjacent a respective corner of the storage cartridge 500. In various embodiments of the invention, the rolling mechanisms 510, 512, 514 are mounted to swivel relative to the storage cartridge 500 (e.g., much like the wheels of a standard shopping cart).

Dispenser Housing

In various embodiments of the invention, the dispenser 10 includes a dispenser housing 100 that comprises a dispenser body 200 and an access door 300. These are discussed in greater detail below.

1. Dispenser Body

As may be understood from FIG. 2, in one embodiment of the invention, the dispenser body 200 defines both an interior portion 203, and a dispenser body access opening 205 through which the dispenser's storage cartridge 500 may be wheeled into the dispenser housing 200. In various embodiments of the invention, the dispenser body's interior portion 203 is dimensioned to receive the storage cartridge 500 substantially entirely within this interior portion 203.

2. Access Door

In certain embodiments of the invention (such as the embodiment shown in FIGS. 1 and 2), the dispenser's access door 300 comprises one or more user doors 401-403 that are each configured to provide selective access to items stored within the dispenser 10. An exemplary structure for (and corresponding functionality of) these user doors 401-403 is described in detail in U.S. Patent Publication No. 2005/0060938 (application Ser. No. 10/671,301), which is entitled "Automated Sliding User Doors and Door Mechanisms for a Dispenser", and which is hereby incorporated by reference.

As shown in FIGS. 1-7, in the depicted embodiment of the invention, the dispenser's access door 300 is mounted to selectively restrict access to the dispenser body's interior portion 203. For example, in the embodiment shown in FIG. 1, the access door 300 is mounted adjacent the dispenser body 200 on hinges so that the access door 300 may rotate between: (1) an open position in which the access door 300 does not substantially restrict access to the interior portion 203 of the dispenser body 200; and (2) a closed position in which the access door 300 substantially restricts (and preferably prevents) access to the dispenser body's interior portion 203.

As discussed in greater detail below, in various embodiments of the invention, the dispenser's access door 300 is adapted so that it may be used to laterally sweep the storage cartridge 500 into the dispenser body's interior portion 203. For example, in the embodiment of the invention shown in FIGS. 1-7, the access door 300 is adapted to sweep the storage cartridge 500 from: (1) a "loading position" in which a particular rolling mechanism 510 associated with the storage cartridge 500 is received within the rolling mechanism guide 210 and the storage cartridge 500 is not disposed substantially within the dispenser housing 100 (see FIG. 3); and (2) a "loaded position" in which the storage cartridge is disposed substantially within the dispenser housing (see FIG. 7). In various embodiments of the invention, the particular rolling mechanism 510 remains received within the rolling mechanism guide 210 as the dispenser cartridge 500 is moved from the "loading position" to the "loaded position".

Storage Cartridge Positioning System

In various embodiments of the invention, the dispenser's storage cartridge positioning system comprises: (1) a rolling mechanism guide 210; (2) guide markings 250; and (3) a storage position sensing system. These are each discussed below.

1. Rolling Mechanism Guide

In various embodiments of the invention, the dispenser 10 includes a rolling mechanism guide 210 that is adapted to guide one or more rolling mechanisms 510-514 associated with the storage cartridge 500 into a predetermined position relative to the dispenser housing 100. In one embodiment of the invention, this predetermined position is a "loading position" in which the storage cartridge 500 is positioned at least partially in a path traveled by the access door 300 as the access door 300 moves between an open and a closed position. In a particular embodiment of the invention, the rolling mechanism guide 210 is adapted to receive at least one rolling mechanism (e.g., a wheel) 510, 512, 514 associated with the storage cartridge 500 and to maintain the at least one rolling mechanism 510, 512, 514 in a substantially fixed lateral position relative to the dispenser housing 100 as the storage cartridge 500 is being moved from the "loading position" into the "loaded position" (e.g., by the access door 300). For example, in the embodiment of the invention shown in FIGS. 1-7, the rolling mechanism guide 210 is adapted to receive the storage cartridge's leading exterior wheel 510, and to maintain this wheel 510 in a substantially fixed lateral position relative to the dispenser housing 100 as the storage cartridge 500 is being moved from the "loading position" into the "loaded position" by the access door 300. In this embodiment of the invention, the storage cartridge 500 is configured to pivot about the leading outer wheel 510 as the storage cartridge 500 is moved from the "loading position" to the "loaded position".

As may be understood from FIGS. 1-7, in one embodiment of the invention, the rolling mechanism guide 210 comprises a substantially V-shaped rolling mechanism guiding portion 211. In a particular embodiment of the invention, this rolling mechanism guiding portion 211 includes a rear elongated guide rail 214 and a front elongated guide rail 212 that are disposed in substantially the same plane and that are angled relative to each other. In this embodiment, the rolling mechanism guiding portion 211 further includes a stopper 216 that is adjacent a base portion of the V-shaped rolling mechanism guiding portion 211 (e.g., adjacent an intersection point of the major axes of the front and rear guide rails 212, 214). As may be understood from FIGS. 1-7, the front guide rail 212, the rear guide rail 214 and/or the stopper 216 may include a stepped portion for facilitating stopping a wheel (e.g., the storage cartridge's leading exterior wheel 510) and for guiding the wheel 510 into a predetermined position relative to the rolling mechanism guide 210 (e.g., by funneling the wheel 510 toward this predetermined position).

In various embodiments of the invention, the rolling mechanism guide 210 comprises a storage cartridge support portion 218 that may, for example, extend at least partially between opposing inner side edges of the V-shaped rolling mechanism guiding portion 211, as shown in FIG. 1 (e.g., between the inner side edges of the front and rear guide rails 212, 214). In various embodiments of the invention, the storage cartridge support portion 218 is configured to support a weight of the storage cartridge 500 as the rolling mechanism guide 210 is guiding a particular rolling mechanism 510 associated with the storage cartridge 500 into a predetermined position relative to the rolling mechanism guide 210.

In certain embodiments of the invention, the rolling mechanism guide 210 comprises a shock absorber 220 that may, for example, extend between the rolling mechanism guide 210 and the dispenser body 200. In various embodiments of the invention, this shock absorber 220 is adapted to reduce the amount of force that the rolling mechanism guide 210 exerts on the dispenser body 200 as a particular rolling mechanism 510 associated with the storage cartridge 500 engages the rolling mechanism guide 210.

2. Storage Cartridge Positioning Guides

In order to further facilitate moving the storage cartridge 500 into the "loading position", one or more storage cartridge positioning guides 250 (see FIG. 4) may be provided within the dispenser body's interior portion. These one or more storage cartridge positioning guides 250 are preferably positioned to visually assist a user in moving the storage cartridge 500 into a "loading position". For example, in the embodiment of the invention shown in FIG. 4, the storage cartridge positioning guides 250 are elongated strips of fabric that attached at one end adjacent the dispenser body's interior upper surface.

In one embodiment of the invention, a first storage cartridge positioning guide 250 is positioned to hang down from the dispenser body's interior upper surface immediately adjacent a first side of the open portion of the V-shaped rolling mechanism guiding portion 211. Similarly, a second storage cartridge positioning guide 250 is positioned to hang down from the dispenser body's interior upper surface immediately adjacent a second side of the open portion of the V-shaped rolling mechanism guiding portion 211. Accordingly, in this embodiment of the invention, the first and second storage cartridge positioning guides 250 are positioned so that a user may move the storage cartridge 500 into the "loaded position" by: (1) aligning a leading outer corner of the storage cartridge 500 between the first and second storage cartridge positioning guides 250; and (2) moving the storage cartridge 500 toward the rolling mechanism guide 210 while maintaining the alignment of the storage cartridge's upper front edge between the storage cartridge positioning guides 250.

Storage Cartridge Position Sensing System

In various embodiments of the invention, the dispenser 10 may include a storage cartridge position sensing system that includes a sensor 242 and an alert mechanism 245. In various embodiments, the sensor 242 is adapted to determine whether the storage cartridge 500 is in a "loading position" (e.g., when a particular event occurs), and the alert mechanism 245 is preferably adapted for issuing an alert to a user in response to the sensor 242 determining that the storage cartridge 500 is not in a "loading position" when a particular event occurs (e.g., when a user begins moving the access door 300 toward a closed position).

1. Sensor

As will be understood by one skilled in the relevant field, the dispenser's sensor 242 may be in any appropriate form. In one embodiment of the invention, the sensor 242 comprises a switch and is disposed adjacent an interior side edge of the dispenser's access door 300. In this embodiment, the sensor 242 is preferably positioned so that the sensor's switch will not be activated in response to the access door 300 being moved adjacent the storage cartridge 500 if the storage cartridge 500 is in a proper "loading position". However, in various embodiments, the sensor 242 is positioned so that the sensor's switch will be activated (e.g., depressed) in response to the access door 300 being moved immediately adjacent the storage cartridge 500 if the storage cartridge 500 is not in a proper "loading position". This may serve, for example, to prevent users from damaging the storage cartridge 500 or the dispenser body 200 by closing the access door 300 when the storage cartridge 500 is positioned between the access door's outer edge and the dispenser body 200. In one embodiment of the invention, the sensor 242 is positioned so that the sensor's switch will engage a portion of the storage cartridge 500 (e.g., the storage cartridge's front trailing corner 520) when the access door 300 is moved adjacent the storage cartridge 500 if the storage cartridge 500 is positioned adjacent the rolling mechanism guide 210, but not entirely within a proper "loading position". In various embodiments of the invention, the sensor 242 activates in response to the sensor's switch engaging the storage cartridge 500.

2. Alert Mechanism

The dispenser's alert mechanism 245 also take any appropriate form or structure. For example, in one embodiment of the invention, the alert mechanism 245 comprises a display screen/speaker combination 245 that is adapted to display a text message to a user and/or to issue an auditory alert (e.g., a warning tone) to a user in response to the sensor 242 determining that the storage cartridge 500 is not in a "loading position" upon the occurrence of a pre-determined event (e.g., a user moving the access door 300 toward a closed position).

Stopping Mechanism

In various embodiments of the invention, the dispenser 10 comprises a stopping mechanism 230 that is adapted for restricting further movement of the storage cartridge 500 toward the dispenser body 200 after the storage cartridge 500 has moved into the "loaded position" referenced above. For example, in the embodiment of the invention shown in FIGS. 6 and 7, the dispenser 10 comprises a substantially L-shaped stopping mechanism 230 disposed adjacent a rear interior portion of the dispenser housing 100.

This stopping mechanism 230 is preferably positioned to engage a rolling mechanism 510, 512, 514 associated with the storage cartridge 500 when the storage cartridge 500 is moved into a "loaded" position within the dispenser housing 100. For example, as shown in FIG. 7A, in various embodiments of the invention, the stopping mechanism 230 is dimensioned and positioned so that when the storage cartridge 500 is in a "loaded" position: (1) a bottom portion of a trailing interior wheel 514 associated with the storage cartridge 500 engages an upper surface of a substantially horizontal portion of the L-shaped stopping mechanism 230; and (2) a side portion of the interior rear wheel 514 engages a side surface of a substantially vertical portion of the L-shaped stopping mechanism 230.

Storage Cartridge Restraint

As may be understood from FIGS. 1-5, in various embodiments of the invention, the dispenser housing 100 comprises a storage cartridge restraint 240 that is adapted for substantially restricting the lateral movement of the storage cartridge 500 relative to the access door 300. This storage cartridge restraint 240 is preferably mounted adjacent the access door 300. In a particular embodiment of the invention, the storage cartridge restraint 240 is positioned to extend outwardly from a rear surface of the access door 300 adjacent the access door's distal side edge. In this embodiment, the storage cartridge restraint 240 is preferably positioned so that the storage cartridge restraint 240 will be disposed immediately adjacent the storage cartridge 500 (e.g., adjacent the storage cartridge's trailing side portion), when the access door 300 is positioned immediately adjacent the storage cartridge's front surface.

Storage Cartridge Attachment Mechanism

As may be understood from FIG. 11, in various embodiments of the invention, the dispenser housing 100 comprises a storage cartridge attachment mechanism 235 that is adapted for: (1) attaching the storage cartridge 500 adjacent (and preferably to) the dispenser housing's access door 300; and (2) maintaining the storage cartridge 500 in place adjacent the access door 300 as the access door 300 is moved between an open and a closed position. This storage cartridge attachment mechanism 235 serves to hold the storage cartridge 500 adjacent the access door 300 as the access door 300 is being closed.

In various embodiments of the invention, the storage cartridge attachment mechanism 235 comprises two, approximately 3-inch, straps that are adapted to extend substantially horizontally around the storage cartridge 500. The ends of these straps may, for example, be respectively attached to the interior surface of the access door 300 (e.g., with one end of each strap being attached adjacent the access door's outer edge, and the other end of each strap being attached adjacent the access door's inner edge).

Operation of Various Embodiments of the Invention

To insert the storage cartridge 500 into the dispenser housing 100, a user first moves the dispenser housing's access door 300 into an open position in which the width of the opening between the access door 300 and the dispenser body 200 is greater than or equal to the width of the storage cartridge 500 (which has preferably been pre-loaded with items to be dispensed from the dispenser 10). (See FIG. 1). The user then moves the storage cartridge 500 toward the dispenser body 200 until the leading outer edge of the storage cartridge 500 is disposed immediately adjacent (e.g., between) the storage cartridge positioning guides 250. In this position, the storage cartridge's leading outer wheel 510 will be positioned adjacent an open portion of the rolling mechanism guide's V-shaped rolling mechanism guiding portion 211.

The user then pushes the storage cartridge 500 toward the rolling mechanism guide 210 until the storage cartridge's leading outer wheel 510 engages a portion of the rolling mechanism guide's V-shaped rolling mechanism guiding portion 211. The V-shaped rolling mechanism guiding portion 211 then guides the leading outer wheel 510 toward the rolling mechanism guide's stopper 216 until the leading outer wheel 510 engages the stopper 216. At this point, the storage cartridge 500 is a "loading position" in which the storage cartridge 500 is positioned to be urged into the dispenser body 200 (e.g., by the access door 300).

As noted above, in various embodiments of the invention, the rolling mechanism guide 210 comprises a storage cartridge support portion 218 that extends at least partially between opposing interior side edges of the V-shaped rolling mechanism guiding portion 211, as shown in FIG. 1. In various embodiments of the invention, the storage cartridge support portion 218 is configured to support at least a portion of the weight of the storage cartridge 500 as the rolling mechanism guide 210 is guiding a particular rolling mechanism 510 associated with the storage cartridge 500 into a predetermined position relative to the rolling mechanism guide 210. This serves to increase the friction between the rolling mechanism guide 210 and a support surface that supports the rolling mechanism guide 210. This increased friction acts to reduce the amount of force that the rolling mechanism guide 210 exerts on the dispenser body 200 as the rolling mechanism 510 associated with the storage cartridge 500 engages the rolling mechanism guide 210. In particular, when the rolling mechanism 510 engages the rolling mechanism guide 210, a portion of the related load is absorbed by the frictional force between the rolling mechanism guide 210 and the support surface that supports the rolling mechanism guide 210 (e.g., a floor).

As noted above, in various embodiments of the invention, the storage cartridge positioning system includes a shock absorber 220 that extends between the rolling mechanism guide 210 and the dispenser body 200. In various embodiments, this shock absorber 220 is adapted to reduce the amount of force that the rolling mechanism guide 210 exerts on the dispenser body 200 as a particular rolling mechanism 510 associated with the storage cartridge 500 engages the rolling mechanism guide 210.

Once the storage cartridge 500 is in place adjacent the rolling mechanism guide 210, the user then rotates the access door 300 toward the dispenser body 200 until the access door 300 engages the storage cartridge's front surface. If the storage cartridge 500 has not been fully inserted into the rolling mechanism guide 210 (e.g., inserted until dispenser cartridge's leading outer wheel 510 engages the rolling mechanism guide's stopper 216), the storage cartridge restraint 240 will engage the storage cartridge's bottom shelf when (or before) the access door 300 engages the front surface of the storage cartridge 500. This will, in turn, activate the position sensing system's sensor 242 (which, in this embodiment of the invention, is disposed adjacent a leading edge of the storage cartridge restraint 240). This causes a signal to be transmitted to the position sensing system's alert mechanism 245.

In response to receiving this signal, the alert mechanism 245 then issues an alert to a user indicating that the storage cartridge 500 is not in a proper loading position. The system alert mechanism 245 may issue this alert, for example, by causing a warning light to flash adjacent the dispenser 10, by issuing an audible warning via a speaker, and/or by displaying a warning message on a display screen 245 associated with the dispenser 10.

Alternatively, if the access door 300 has been fully inserted into the rolling mechanism guide 210, the storage cartridge restraint 240 will engage a trailing outer corner 520 of the storage cartridge 500 when the access door 300 engages the front surface of the storage cartridge 500. Accordingly, when the storage cartridge restraint 240 is in this position, the storage cartridge restraint 240 and the rolling mechanism guide 210 will serve to maintain the storage cartridge 500 in a substantially fixed lateral relationship to the access door 300 as the access door 300 is moved into a closed position. The user then urges the access door 300 toward and into a closed position. During this process, the access door 300 sweeps the storage cartridge 500 into a loaded position within the interior of the dispenser body 200.

If the access door 300 is closed quickly, the storage cartridge 500 will have a tendency to continue rolling toward the rear portion of the dispenser body 200 even after the storage cartridge 500 has reached the "loaded position". In order to prevent the storage cartridge 500 from damaging the dispenser body 200, in various embodiments of the invention, the dispenser body 200 includes a stopping mechanism 230 that is positioned to engage the storage cartridge's trailing inner wheel 514 when the storage cartridge 500 is moved into a "loaded" position within the dispenser housing 100. For example, in the embodiment shown in FIG. 7A, the stopping mechanism 230 is dimensioned and positioned so that, when the storage cartridge 500 is in a "loaded" position: (1) a bottom portion of a trailing inner wheel 514 associated with the storage cartridge 500 engages an upper surface of a substantially horizontal portion of the L-shaped stopping mechanism 230; and (2) a side portion of the trailing inner wheel 514 engages a side surface of a substantially vertical portion of the L-shaped stopping mechanism 230. This serves to slow (and preferably stop) the movement of the storage cartridge 500 toward the interior portion of the dispenser body 200.

After the storage cartridge 500 is in the "loaded" position and the access door 300 is fully closed, the dispenser 10 may be used to selectively dispense items from the interior of the dispenser 10 in a manner generally described in U.S. Patent Publication No. 2005/0060938 (application Ser. No. 10/671,301), entitled "Automated Sliding User Doors and Door Mechanisms for a Dispenser". As noted above, this patent application is incorporated herein by reference.

Although the method described above involves using the access door 300 to move the storage cartridge 500 into the dispenser body's interior portion 203, it should be understood that, in alternative embodiments of the invention, a user may move the storage cartridge 500 into the dispenser body's interior portion 203 in any other suitable way. For example, in an alternative embodiment of the invention, once the storage cartridge 500 is in place adjacent the rolling mechanism guide 210, the user may simply grasp the trailing edge of the storage cartridge 500 and then moves the storage cartridge 500 into the "loaded position" by hand. In this embodiment, once the storage cartridge 500 is in the "loaded position", the user manually moves the access door 300 into a closed position adjacent the storage cartridge 500.

In various embodiments of the invention, the general motion of the storage cartridge 500 as it is moved by hand from the "loading position" to the "loaded position" is substantially the same as when the storage cartridge 500 is moved with the assistance of the access door 300 (e.g., as described above). For example, the storage cartridge 500 may pivot about its leading outer wheel 510 as the storage cartridge 500 moves between the "loading position" into the "loaded position".

As noted above, in various embodiments of the invention, the dispenser 10 comprises an attachment mechanism 235 that is adapted to maintain the storage cartridge 500 in a substantially fixed relationship with the access door 300 as the access door 300 is being moved from an open to a closed position. In a particular embodiment of the invention, this attachment mechanism 235 comprises two, approximately 3-inch, straps that extend substantially horizontally around the storage cartridge 500. These straps may be used: (1) to secure the storage cartridge 500 adjacent (and preferably to) the access door 300 before the access door 300 is used to move the storage cartridge 500 from the loading position to the loaded position; and (2) to maintain the storage cartridge 500 in a substantially fixed relationship with the access door 300 as the access door 300 is being moved from an open to a closed position.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. In addition, although various aspects of the invention are described above in the context of a dispenser (e.g., an automated dispenser), the invention may be implemented in a variety of different contexts. For example, the invention may be embodied in cartridge storage systems that are adapted for: (1) loading a storage cartridge with items to be stored; and (2) moving the loaded storage cartridge into a loaded position within a secure storage cabinet.

Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

What is claimed is:

1. A dispenser comprising:

(A) a dispenser housing comprising:

a dispenser body defining an interior portion and a dispenser body access opening; and an access door that is mounted to selectively restrict access to said interior portion through said access opening;

(B) a storage cartridge that is mounted on one or more rolling mechanisms to roll adjacent said dispenser body; and (C) a storage cartridge positioning system that is adapted to facilitate moving said storage cartridge into a "loading position" in which said storage cartridge is positioned to be loaded into said dispenser, wherein:

said dispenser is configured so that when said storage cartridge is in said loading position, said access door may be moved between a first position, in which said access door does not substantially restrict access to said interior portion through said access opening, and (2) a second position, in which said access door restricts access to said interior portion through said access opening;

said dispenser is further configured so that the motion of said access door from said first position to said second position serves to urge said storage cartridge from said "loading position" into a "loaded position" in which said storage cartridge is disposed substantially within said dispenser housings;

said storage cartridge positioning system is adapted to receive a particular one of said one or more rolling mechanisms and to maintain said rolling mechanism in a substantially fixed lateral position relative to said dispenser housing as said storage cartridge is being moved from said "loading position" into said "loaded position";

said storage cartridge positioning system comprises a rolling mechanism guide that is adapted to guide said particular rolling mechanism into a predetermined position relative to said dispenser housing;

said rolling mechanism guide comprises a shock absorber disposed between said rolling mechanism support portion and said dispenser housings; and said shock absorber is adapted to reduce the force exerted on said dispenser housing when said storage cartridge engages said rolling mechanism guide.

2. The dispenser of claim 1, wherein said rolling mechanism guide comprises a substantially V-shaped rolling mechanism guiding portion that is adapted to guide said particular rolling mechanism toward said predetermined position.

3. The dispenser of claim 2, wherein said rolling mechanism guide further comprises a stopper adjacent a base portion of said V-shaped rolling mechanism guiding portion for stopping said particular rolling mechanism when said particular rolling mechanism is immediately adjacent said base portion.

4. The dispenser of claim 3, wherein:

said rolling mechanism guide comprises a storage cartridge support portion that extends at least partially between opposing side edges of said V-shaped rolling mechanism guiding portion, and said rolling mechanism guide is configured so that as said storage cartridge is moved into said "loading position", said rolling mechanism:

(A) moves onto said rolling mechanism support portion, and (B) is guided into place adjacent said stopper by said rolling mechanism guiding portion.

5. The dispenser of claim 1, wherein said rolling mechanism guide comprises a storage cartridge support portion for at least partially supporting a weight of said storage cartridge as said particular rolling mechanism guide is guiding said particular rolling mechanism into said predetermined position.

6. The dispenser of claim 5, wherein said dispenser is configured so that having said rolling mechanism at least partially support said weight of said storage cartridge results in an increase in the amount of friction between said rolling mechanism guide and a support surface on which rolling mechanism guide is disposed.

7. The dispenser of claim 1, wherein said storage cartridge positioning system comprises one or more storage cartridge positioning guides to facilitate moving said storage cartridge into a "loading position".

8. The dispenser of claim 1, wherein said storage cartridge positioning system comprises a position sensing system comprising: (A) a sensor that is adapted for determining whether said storage cartridge is in said "loading position"; and (B) an alert mechanism that is adapted for issuing an alert to a user in response to said sensor determining that said storage cartridge is not in said "loading position".

9. The dispenser of claim 8, wherein said position sensing system is adapted for determining whether said cartridge is in said "loading position" in response to said user moving said access door adjacent said storage cartridge.

10. The dispenser of claim 9, wherein said sensor is mounted adjacent said access door.

11. The dispenser of claim 1, wherein said dispenser further comprises a storage cartridge restraint that is adapted for substantially restricting the lateral movement of said storage cartridge relative to said access door, said storage cartridge restraint being mounted adjacent said access door.

12. The dispenser of claim 1, wherein:

said dispenser further comprises an attachment mechanism for attaching said storage cartridge adjacent said access door; and said access door is adapted to be moved between said first and second positions while said storage cartridge is attached adjacent said access door via said attachment mechanism.

13. The dispenser of claim 1, wherein said dispenser comprises a stopping mechanism for restricting further movement of said storage cartridge toward said dispenser housing after said storage cartridge has moved into said "loaded position".

14. The dispenser of claim 13, wherein:

said particular rolling mechanism is a first rolling mechanism;

said one or more rolling mechanisms comprises a second rolling mechanism; and said stopper is configured to engage said second rolling mechanism when said storage cartridge is in said loaded position.

15. The dispenser of claim 1, wherein:

said storage cartridge positioning system comprises a rolling mechanism guide comprising a stepped portion that is adapted to guide a particular one of said rolling mechanisms into a predetermined position relative to said dispenser housing.

16. The dispenser of claim 1, wherein said access door is adapted so that when said storage cartridge is in said loaded position, said access door may be moved into a closed position in which said access door selectively prevents access to said storage cartridge through said access opening.

17. The dispenser of claim 1, wherein:

said storage cartridge includes one or more shelves; and said access door comprises at least one user door that is adapted to selectively restrict access to one or more items disposed on a particular one of said shelves.

18. The dispenser of claim 1, wherein:

said storage cartridge positioning system is adapted to receive a particular one of said one or more rolling mechanisms;

said particular rolling mechanism is mounted to swivel relative to said storage cartridge; and said storage cartridge positioning system is adapted to maintain said particular rolling mechanism in a substantially fixed position as said storage cartridge is moved from said "loading position" to said "loaded position".

19. The dispenser of claim 18, wherein said storage cartridge is configured to pivot about said particular rolling mechanism from said "loading position" to said "loaded position".

20. The dispenser of claim 18, wherein said access door is adapted to rotate said storage cartridge from said "loading position" to said "loaded position" as said access door is moved from: (A) an "open" position in which said access door does not substantially restrict access to said interior portion to (B) a "closed" position in which said access door substantially restricts access to said interior portion through said access opening.

21. The dispenser of claim 1, wherein said dispenser is adapted to selectively, and in an automated fashion, provide users with access to one or more items disposed within said dispenser housing.

22. The dispenser of claim 1, wherein at least one of said rolling mechanisms is a wheel.

* * * * *

UNITED STATES PATENT AND TRADEMARK OFFICE

CERTIFICATE OF CORRECTION

PATENT NO. : 7,407,238 B2
APPLICATION NO. : 11/122285
DATED : August 5, 2008
INVENTOR(S) : Fitzgerald It is certified that error appears in the above-identified patent and that said Letters Patent is hereby corrected as shown below:

Column 11,

Line 39 and 53, “housings” should read --housing--.

Signed and Sealed this

Fourth Day of November, 2008

JON W. DUDAS
*Director of the United States Patent and Trademark Office*